US011879188B2

(12) United States Patent
Jing

(10) Patent No.: US 11,879,188 B2
(45) Date of Patent: Jan. 23, 2024

(54) ENERGY ABSORBER, METHOD FOR WEAVING ENERGY ABSORBER, AND WEAVING DEVICE

(71) Applicant: Dongguan Polyunion Textile Technology Co., LTD., Dongguan (CN)

(72) Inventor: Pei Jing, Dongguan (CN)

(73) Assignee: Dongguan Polyunion Textile Technology Co., LTD., Dongguan (CN)

( * ) Notice: Subject to any disclaimer, the term of this patent is extended or adjusted under 35 U.S.C. 154(b) by 29 days.

(21) Appl. No.: 17/712,058

(22) Filed: Apr. 1, 2022

(65) Prior Publication Data

US 2023/0183893 A1 Jun. 15, 2023

(30) Foreign Application Priority Data

Dec. 10, 2021 (CN) ..... 202111508091.6

(51) Int. Cl.

| | |
|---|---|
| ***D03D 11/02*** | (2006.01) |
| ***D03D 1/00*** | (2006.01) |
| ***D03D 15/56*** | (2021.01) |
| ***D03D 11/00*** | (2006.01) |
| ***D03D 17/00*** | (2006.01) |

(52) U.S. Cl.

CPC ..... *D03D 15/56* (2021.01); *D03D 1/0005* (2013.01); *D03D 11/00* (2013.01); *D03D 17/00* (2013.01); *D10B 2401/061* (2013.01)

(58) Field of Classification Search

CPC ..... D03D 15/56; D03D 1/0005; D03D 11/00; D03D 17/00; D03D 11/02; D03D 3/005; D03D 15/50; D03D 47/12; D10B 2401/061; A62B 35/04

See application file for complete search history.

(56) References Cited

U.S. PATENT DOCUMENTS

| | | | | | |
|---|---|---|---|---|---|
| 2,401,260 | A * | 5/1946 | Lord | F16G 1/04 | 474/271 |
| 2,831,235 | A * | 4/1958 | Taylor | H01B 3/084 | 28/169 |
| 3,444,957 | A * | 5/1969 | Gilpin, Jr. | A62B 35/04 | 182/3 |
| 3,563,498 | A * | 2/1971 | Haile | B64D 25/10 | 188/268 |
| 3,827,660 | A * | 8/1974 | Doolittle | B64F 1/027 | 244/110 C |
| 3,861,744 | A * | 1/1975 | Yamada | B60R 22/16 | 297/472 |
| 3,941,162 | A * | 3/1976 | McCabe | D03D 15/573 | 442/187 |

(Continued)

*Primary Examiner* — Robert H Muromoto, Jr.

(57) ABSTRACT

An energy absorber includes a first split section, a first single strand section, a second split section, a second single strand section, and a third split section which are connected in sequence. The first split section and the third split section each include at least two sub-woven belts. The at least two sub-woven belts are separated from each other. At least one of the at least two sub-woven belts is capable of being stretched and contracted under an action of an external force. The first split section, the first single strand section, the second split section, the second single strand section and the third split section are integrally woven.

10 Claims, 6 Drawing Sheets

(56) References Cited

U.S. PATENT DOCUMENTS 4,094,402 A * 6/1978 Heeke ..... B65G 15/36 428/212
4,515,254 A * 5/1985 Markov ..... B60R 22/28 280/805
4,559,411 A * 12/1985 Piper ..... H01B 7/083 29/857
4,606,441 A * 8/1986 Markov ..... B60R 22/28 280/805
4,660,605 A * 4/1987 Koch ..... D03D 1/0005 139/117
4,750,529 A * 6/1988 Watanabe ..... D03C 15/00 428/193
4,800,929 A * 1/1989 Watanabe ..... D03D 47/40 428/193
5,658,012 A * 8/1997 Villarreal ..... B60R 22/16 280/805
7,337,810 B2 * 3/2008 Orr ..... D03D 11/02 139/423
7,665,575 B2 * 2/2010 Tanaka ..... D03D 11/00 182/3
7,677,360 B2 3/2010 Tanaka et al.
7,726,350 B2 * 6/2010 Jennings ..... E06C 7/186 182/7
7,780,194 B2 * 8/2010 Trondle ..... B60R 21/235 442/76
8,316,988 B2 * 11/2012 Russell ..... D03D 11/00 182/3
8,387,750 B2 * 3/2013 Russell ..... A62B 35/04 182/3
8,869,841 B2 * 10/2014 He ..... D03D 17/00 139/420 R
8,925,592 B2 * 1/2015 Itoh ..... D03D 3/08 138/123
9,127,381 B2 * 9/2015 Gao ..... D03D 1/0043
9,260,804 B2 * 2/2016 He ..... D03D 3/005
9,328,436 B2 * 5/2016 Russell ..... A62B 35/0093
10,675,490 B2 * 6/2020 Blondeau ..... A62B 35/0006
11,198,027 B2 * 12/2021 Green Mullins .. A62B 35/0075
2006/0169534 A1 * 8/2006 Green ..... A63B 27/00 182/7
2006/0266581 A1 11/2006 Tanaka et al.
2007/0267084 A1 * 11/2007 Pereira ..... D03D 15/56 139/116.1
2008/0190691 A1 8/2008 Tanaka et al.
2009/0014084 A1 * 1/2009 Hawkins ..... D06M 15/693 156/137
2011/0076906 A1 * 3/2011 Cheung ..... D03D 3/005 442/184
2011/0151155 A1 * 6/2011 He ..... D03D 3/005 442/205
2012/0111439 A1 5/2012 Russell et al.
2014/0110015 A1 * 4/2014 He ..... D03D 3/00 139/11
2021/0052452 A1 * 2/2021 Rathke ..... A61G 7/1013
2021/0071365 A1 * 3/2021 Sealey, II ..... B32B 27/285
2021/0274856 A1 * 9/2021 Blythe ..... A41B 9/14
2022/0347019 A1 * 11/2022 Tamoué ..... D04H 3/007

* cited by examiner

| 1 | 2 | 3 | 4 | 5 | 6 | 7 | 8 | 9 | 10 | 11 |
|---|---|---|---|---|---|---|---|---|---|---|
| XX | OO | XX | OO | OO | OX | OO | XO | XO | XX | XO |
| XX | OO | XX | OX | OX | OX | OO | XX | XX | XX | XO |
| OO | XX | XX | OX | OO | OO | OO | XX | XO | XO | XO |
| OO | XX | XX | OX | OO | OX | OX | XX | XO | XX | XX |
| XX | OO | XX | OO | OO | OX | OO | XO | XO | XX | XO |
| XX | OO | XX | OX | OX | OX | OO | XX | XX | XX | XO |
| OO | XX | XX | OX | OO | OO | OO | XX | XO | XO | XO |
| OO | XX | XX | OX | OO | OX | OX | XX | XO | XX | XX |

| 1 | 2 | 3 | 4 | 5 | 6 | 7 | 8 | 9 | 10 | 11 |
|---|---|---|---|---|---|---|---|---|---|---|
| XO | OX | XO | OO | OO | OX | OO | XO | XO | XX | XO |
| XX | OO | XX | OX | OX | OX | OO | XX | XX | XX | XO |
| XO | OO | XX | OX | OO | OX | OO | XX | XO | XX | XO |
| XX | OX | XX | OX | OO | OX | OO | XX | XO | XX | XO |
| XO | OX | XO | OX | OO | OO | OO | XX | XO | XO | XO |
| XX | OO | XX | OX | OO | OX | OX | XX | XO | XX | XX |
| XO | OO | XX | OX | OO | OX | OO | XX | XO | XX | XO |
| XX | OX | XX | OX | OO | OX | OO | XX | XO | XX | XO |
| XX | OX | XO | OO | OO | OX | OO | XO | XO | XX | XO |
| XX | OO | XX | OX | OX | OX | OO | XX | XX | XX | XO |
| XO | OO | XX | OX | OO | OX | OO | XX | XO | XX | XO |
| XX | OX | XX | OX | OO | OX | OO | XX | XO | XX | XO |
| XO | OX | XO | OX | OO | OO | OO | XX | XO | XO | XO |
| XX | OO | XX | OX | OO | OX | OX | XX | XO | XX | XX |
| XO | OO | XX | OX | OO | OX | OO | XX | XO | XX | XO |
| XX | OX | XX | OX | OO | OX | OO | XX | XO | XX | XO |
| XO | OX | XO | OO | OO | OX | OO | XO | XO | XX | XO |
| XX | OO | XX | OX | OX | OX | OO | XX | XX | XX | XO |
| XO | OO | XO | OX | OO | OX | OO | XX | XO | XX | XO |
| XX | OX | XO | OX | OO | OX | OO | XX | XO | XX | XO |
| XO | OX | XO | OX | OO | OO | OO | XX | XO | XO | XO |
| XX | OO | XX | OX | OO | OX | OX | XX | XO | XX | XX |
| XO | OO | XO | OX | OO | OX | OO | XX | XO | XX | XO |
| XX | OX | XO | OX | OO | OX | OO | XX | XO | XX | XO |
| XO | OX | XO | OO | OO | OX | OO | XO | XO | XX | XO |
| XO | OO | XX | OX | OX | OX | OO | XX | XX | XX | XO |
| XO | OO | XO | OX | OO | OX | OO | XX | XO | XX | XO |
| XX | OX | XO | OX | OO | OX | OO | XX | XO | XX | XO |
| XO | OX | XO | OX | OO | OO | OO | XX | XO | XO | XO |
| XX | OO | XX | OX | OO | OX | OX | XX | XO | XX | XX |
| XO | OO | XO | OX | OO | OX | OO | XX | XO | XX | XO |
| XX | OX | XO | OX | OO | OX | OO | XX | XO | XX | XO |

FIG. 9

| 1 | 2 | 3 | 4 | 5 | 6 | 7 | 8 | 9 | 10 | 11 |
|---|---|---|---|---|---|---|---|---|---|---|
| XO | OO | XX | OO | OO | OX | OO | XO | XO | XX | XO |
| XO | OO | XX | OX | OX | OX | OO | XX | XX | XX | XO |
| XX | OX | XO | OX | OO | OO | OO | XX | XO | XO | XO |
| XX | OX | XO | OX | OO | OX | OX | XX | XO | XX | XX |
| XO | OO | XX | OO | OO | OX | OO | XO | XO | XX | XO |
| XO | OO | XX | OX | OX | OX | OO | XX | XX | XX | XO |
| XX | OX | XO | OX | OO | OO | OO | XX | XO | XO | XO |
| XX | OX | XO | OX | OO | OX | OX | XX | XO | XX | XX |

FIG. 10

ENERGY ABSORBER, METHOD FOR WEAVING ENERGY ABSORBER, AND WEAVING DEVICE

TECHNICAL FIELD

The present disclosure relates to the technical field of weaving, and more specifically, to an energy absorber, a method for weaving the energy absorber, and a weaving device.

BACKGROUND

Ribbons, such as elastic ribbon and buffer ribbon, are widely used in the textile industry and the daily life, especially in the clothing industry.

However, in the related weaving technology, the elastic belt and buffer belt should be woven separately, then the elastic belt and buffer belt are combined to form the energy absorber.

SUMMARY

In view of the above problems, the present disclosure provides an energy absorber, a method for weaving the energy absorber, and a weaving device, aiming to eliminate a subsequent sewing operation, save ribbon materials, reduce labor costs, and improve the beauty of the energy absorber through an integrated weaving mode.

A technical solution adopted in the present disclosure is to provide an energy absorber, which includes a first split section, a first single strand section, a second split section, a second single strand section, and a third split section, the first split section, the first single strand section, the second split section, the second single strand section, and the third split section are connected in sequence, the first split section and the third split section each include at least two sub-woven belts, the at least two sub-woven belts are separated from each other, at least one of the at least two sub-woven belts is capable of being stretched and contracted under an action of an external force, the first split section, the first single strand section, the second split section, the second single strand section, and the third split section are integrally woven.

Further, the first split section includes a first sub-woven belt and a second sub-woven belt, a first end of the first sub-woven belt and a first end of the second sub-woven belt are connected to the first single strand section, and the first sub-woven belt is capable of being stretched and contracted under the action of the external force.

Further, the first sub-woven belt includes a first face yarn layer, a first bottom yarn layer, a first elastic belt, and a first suture, the first face yarn layer is opposite to the first bottom yarn layer, and the first elastic belt is interwoven with the first face yarn layer and the first bottom yarn layer at intervals according to a first preset interweaving density, the first suture is interwoven with the first face yarn layer and the first bottom yarn layer.

Further, the first elastic belt is interwoven with the first face yarn layer to form a first area, a second area in the first bottom yarn layer corresponding to the first area is curved due to a contraction of the first elastic belt, the first elastic belt is interwoven with the first bottom yarn layer to form a third area, and a fourth area in the first face yarn layer corresponding to the third area is curved due to the contraction of the first elastic belt.

Further, the first single strand section includes a third sub-woven belt, a fourth sub-woven belt, a second elastic belt, and a second suture, the third sub-woven belt is connected to the first sub-woven belt, and the fourth sub-woven belt is connected to the second sub-woven belt, the second elastic belt is connected to the first elastic belt, the third sub-woven belt is interwoven with the fourth sub-woven belt by the second suture, the second elastic belt is arranged on a side of the third sub-woven belt away from the fourth sub-woven belt.

Further, an interweaving density of the second suture is decreased along a split direction of the first split section.

Further, the second split section includes a fifth sub-woven belt, a sixth sub-woven belt, and a third elastic belt, the fifth sub-woven belt is connected to the third sub-woven belt, the sixth sub-woven belt is connected to the fourth sub-woven belt, the third elastic belt is connected to the second elastic belt, the fifth sub-woven belt is separated from the sixth sub-woven belt, and the third elastic belt is interwoven with the fifth sub-woven belt.

Further, the fifth sub-woven belt is curved relative to the sixth sub-woven belt.

Another technical solution adopted in the present disclosure is to provide a method for weaving an energy absorber, which includes: weaving a first split section, a first single strand section, a second split section, a second single strand section, and a third split section in sequence, the first split section and the third split section each include at least two sub-woven belts, the at least two sub-woven belts are separated from each other, at least one of the at least two sub-woven belts is capable of being stretched and contracted under an action of an external force, the first split section, the first single strand section, the second split section, the second single strand section, and the third split section are integrally woven.

A further technical solution adopted in the present disclosure is to provide a weaving device, the weaving device is configured to perform the method to weave the energy absorber.

Different from the existing art, the energy absorber of the present disclosure includes a first split section, a first single strand section, a second split section, a second single strand section, and a third split section which are connected in sequence. The first split section and the third split section each include at least two sub-woven belts, the at least two sub-woven belts are separated from each other, at least one of the at least two sub-woven belts is capable of being stretched and contracted under an action of an external force, the first split section, the first single strand section, the second split section, the second single strand section, and the third split section are integrally woven. Through the above method, the first split section and the third split section which are capable of being stretched and contracted are woven with the first single strand section, the second split section, and the second single strand section which have a buffer function together, so as to eliminate a subsequent sewing operation, save ribbon materials, reduce labor costs, and improve the beauty of the energy absorber through an integrated weaving mode. The energy absorber of the present disclosure can be used for personal fall protector and high-altitude rescue protector.

BRIEF DESCRIPTION OF THE DRAWINGS

To describe the technical solutions in the embodiments of the present disclosure more clearly, the following briefly introduces the accompanying drawings required for describing the embodiments. Apparently, the accompanying drawings in the following description show only some embodiments of this application, and a person of ordinary skill in the art may still derive other accompanying drawings from these accompanying drawings without creative efforts.

FIG. 9 is a schematic diagram of a part of an organizational structure of the first split section or a part of an organizational structure of the third split section of the present disclosure;

FIG. 10 is a schematic diagram of a part of an organizational structure of the second split section of the present disclosure;

Figure 11:
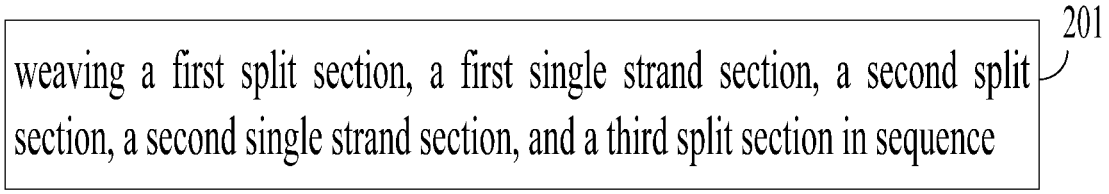

In the organization structure, XX is defined as all up, XO is defined as middle-upper, OX is defined as middle-bottom, OO is defined as all down; 1 and 2 are defined as a suture, 3 is defined as an elastic belt, 4 to 7 are defined as a bottom warp, 8 to 11 are defined as an upper warp;

FIG. 11 is a flow chart of a method for weaving an energy absorber according to an embodiment of the present disclosure.

DETAILED DESCRIPTION OF THE EMBODIMENTS

The technical solution in the embodiments of the present disclosure will be clearly and completely described below with reference to the drawings in the embodiments of the present disclosure. It will be appreciated that the specific embodiments described herein are only used to explain the present disclosure, but not to limit the present disclosure. In addition, for ease of description, the drawings only show a part of the structure related to the present disclosure instead of all of the structure. Based on the embodiments in present disclosure, all other embodiments obtained by a person of ordinary skill in the art without any creative work shall fall within the protection scope of the present disclosure.

"Embodiments" herein means that specific features, specific structures, or specific characteristics described in the embodiments may be included in at least one embodiment of the present disclosure. The "embodiments" in various places of the specification does not necessarily refer to the same embodiment, nor refer to independent or alternative embodiments mutually exclusive with other embodiments. Those skilled in the art clearly and implicitly understand that the embodiments described herein can be combined with other embodiments.

Figure 1:
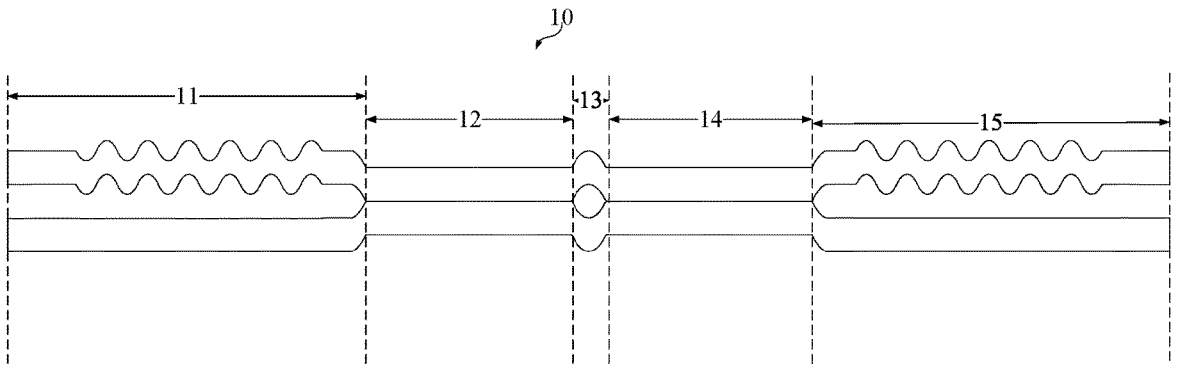
FIG. 1 is a schematic structural view of an energy absorber according to an embodiment of the present disclosure.

FIG. 1 is a schematic structural view of an energy absorber according to an embodiment of the present disclosure. Referring to FIG. 1, the energy absorber includes a first split section 11, a first single strand section 12, a second split section 13, a second single strand section 14, and a third split section 15.

The first split section 11, the first single strand section 12, the second split section 13, the second single strand section 14, and the third split section 15 are woven by warp yarns and weft yarns according to a preset organizational structure.

The first split section 11 includes at least two sub-woven belts, the at least two sub-woven belts are separated from each other, at least one of the at least two sub-woven belts is capable of being stretched and contracted under an action of an external force. For example, when a direction of the external force is along a length direction of the first split section 11, the sub-woven belt can stretch and contract along the length direction of the first split section 11 under the action of the external force, and the sub-woven belt becomes longer; and when the external force is removed, the sub-woven belt returns to its normal state. The third split section 15 is similar to the first split section 11, and can be woven in the same way as the first split section 11.

In the first split section 11, the stretchable sub-woven belt is woven with elastic fabric. So that the stretchable sub-woven belt has elasticity, and can be deformed and lengthened under the action of the external force. The first split section 11, the first single strand section 12, the second split section 13, the second single strand section 14, and the third split section 15 are integrally woven.

Figure 2:
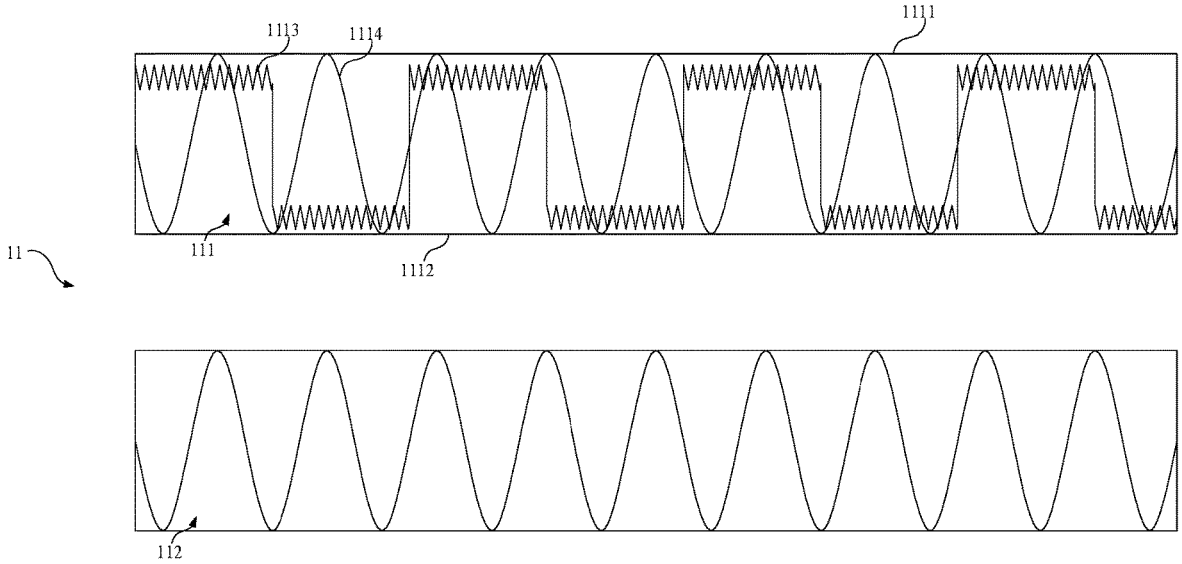
FIG. 2 is a schematic structural view of a first split section in FIG. 1.
Figure 3:
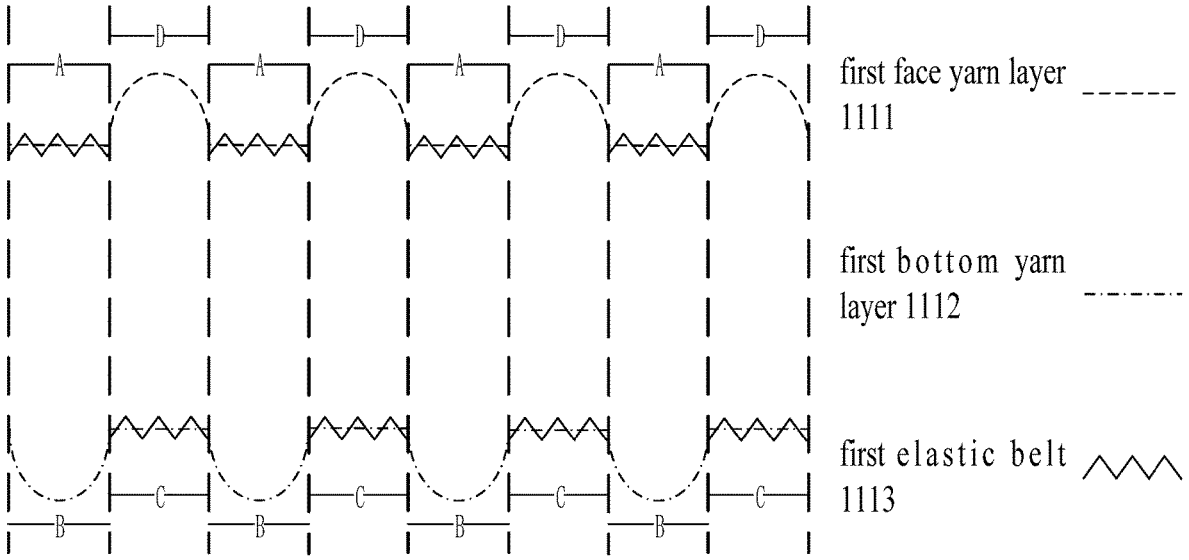
FIG. 3 is a schematic structural view of a first sub-woven belt of the present disclosure.

Specifically, referring to FIG. 2 and FIG. 3, the first split section 11 includes a first sub-woven belt 111 and a second sub-woven belt 112. A first end of the first sub-woven belt 111 and a first end of the second sub-woven belt 112 are connected to the first single strand section 12, and the first sub-woven belt is capable of being stretched and contracted under the action of the external force.

Specifically, referring to FIG. 2 and FIG. 3, the first sub-woven belt 111 includes a first face yarn layer 1111, a first bottom yarn layer 1112, a first elastic belt 1113, and a first suture 1114. The first face yarn layer 1111 is opposite to the first bottom yarn layer 1112, and the first elastic belt 1113 is interwoven with the first face yarn layer 1111 and the first bottom yarn layer 1112 at intervals according to a first preset interweaving density, the first suture 1114 is interwoven with the first face yarn layer 1111 and the first bottom yarn layer 1112. In some embodiments, the second sub-woven belt 112 also includes a suture.

Referring to FIG. 3, the first elastic belt 1113 is interwoven with the first face yarn layer 1111 to form a first area A, a second area B in the first bottom yarn layer 1112 corresponding to the first area A is curved due to a contraction of the first elastic belt 1113, the first elastic belt 1113 is interwoven with the first bottom yarn layer 1112 to form a third area C, and a fourth area D in the first face yarn layer 1111 corresponding to the third area C is curved due to the contraction of the first elastic belt 1113. It can be understood that, as shown in FIG. 3, when the first elastic belt 1113 is interwoven with the first face yarn layer 1111 to form the first area A, the first elastic belt 1113 does not existed in the second area B of the first bottom yarn layer 1112. When the first elastic belt 1113 is interwoven with the first bottom yarn layer 1112 form the third area C, the first elastic belt 1113 does not existed in the fourth area D of the first face yarn layer 1111. The number of first elastic belt 1113 can be set according to actual needs, and there is no limitation here. Therefore, the area without the first elastic belt 1113 is curved with the contraction of the first elastic belt 1113. The third split section 15 is similar to the first split section 11, so it's no need to repeat here.

Figure 4:
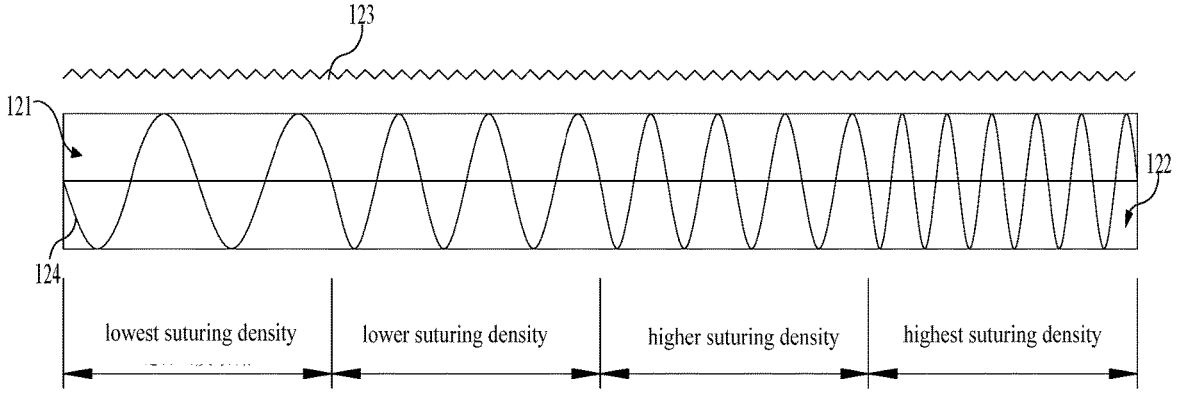
FIG. 4 is a schematic structural view of a first single strand section of the present disclosure.

Referring to FIG. 4, the first single strand section 12 includes a third sub-woven belt 121, a fourth sub-woven belt 122, a second elastic belt 123, and a second suture 124, the third sub-woven belt 121 is connected to the first sub-woven belt, and the fourth sub-woven belt is connected to the second sub-woven belt, the second elastic belt is connected to the first elastic belt, the third sub-woven belt is interwoven with the fourth sub-woven belt by the second suture 124, the second elastic belt is arranged on a side of the third sub-woven belt away from the fourth sub-woven belt. The second suture 124 is connected to the first suture 1114. In some embodiments, the second suture 124 is the first suture 1114.

An interweaving density of the second suture 124 is decreased along a split direction of the first split section, so that a different area of the ribbon has a different tearing buffer force.

Figure 5:
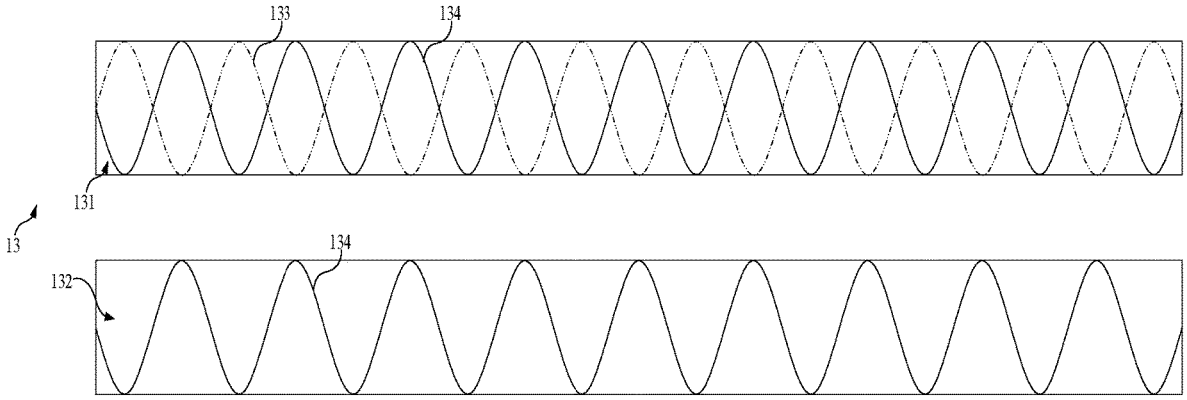
FIG. 5 is a schematic structural view of a second split section of the present disclosure.

Referring to FIG. 5, the second split section 13 includes a fifth sub-woven belt 131, a sixth sub-woven belt 132, and a third elastic belt 133, the fifth sub-woven belt 131 is connected to the third sub-woven belt, the sixth sub-woven belt 132 is connected to the fourth sub-woven belt, the third elastic belt 133 is connected to the second elastic belt, the fifth sub-woven belt 131 is separated from the sixth sub-woven belt 132, and the third elastic belt 133 is interwoven with the fifth sub-woven belt 131.

The fifth sub-woven belt 131 is curved relative to the sixth sub-woven belt 132.

It can be understood that the first split section 11, the first single strand section 12, the second split section 13, the second single strand section 14, and the third split section 15 all have a face yarn layer, a bottom yarn layer, and a suture. The elastic belt may be a rubber belt.

Different from the existing art, the energy absorber of the present disclosure includes a first split section, a first single strand section, a second split section, a second single strand section, and a third split section which are connected in sequence. The first split section and the third split section each include at least two sub-woven belts, the at least two sub-woven belts are separated from each other, at least one of the at least two sub-woven belts is capable of being stretched and contracted under an action of an external force, the first split section, the first single strand section, the second split section, the second single strand section, and the third split section are integrally woven. Through the above method, the first split section and the third split section which are capable of being stretched and contracted are woven with the first single strand section, the second split section, and the second single strand section which have a buffer function together, so as to eliminate a subsequent sewing operation, save ribbon materials, reduce labor costs, and improve the beauty of the energy absorber through an integrated weaving mode. The energy absorber of the present disclosure can be used for personal fall protector and high-altitude rescue protector.

Figure 6:
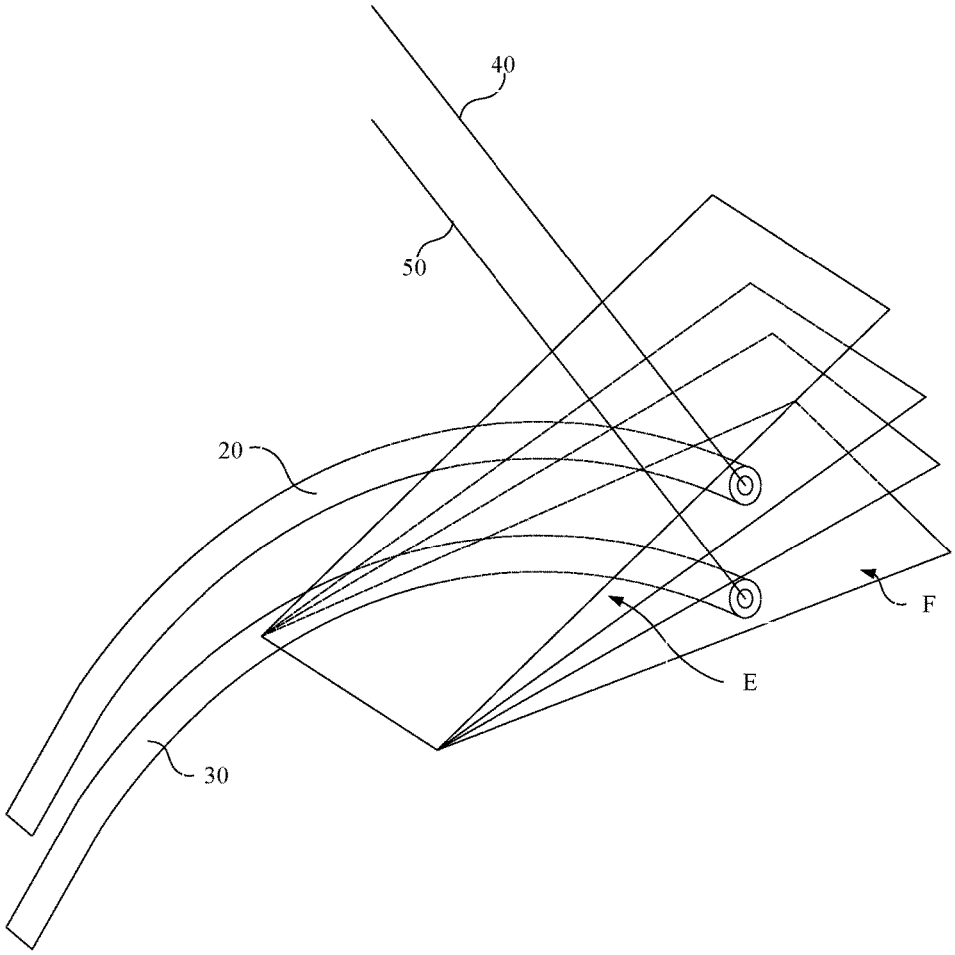
FIG. 6 is an application scene diagram of the elastic buffer belt of the present disclosure.
Figures 7, 8:
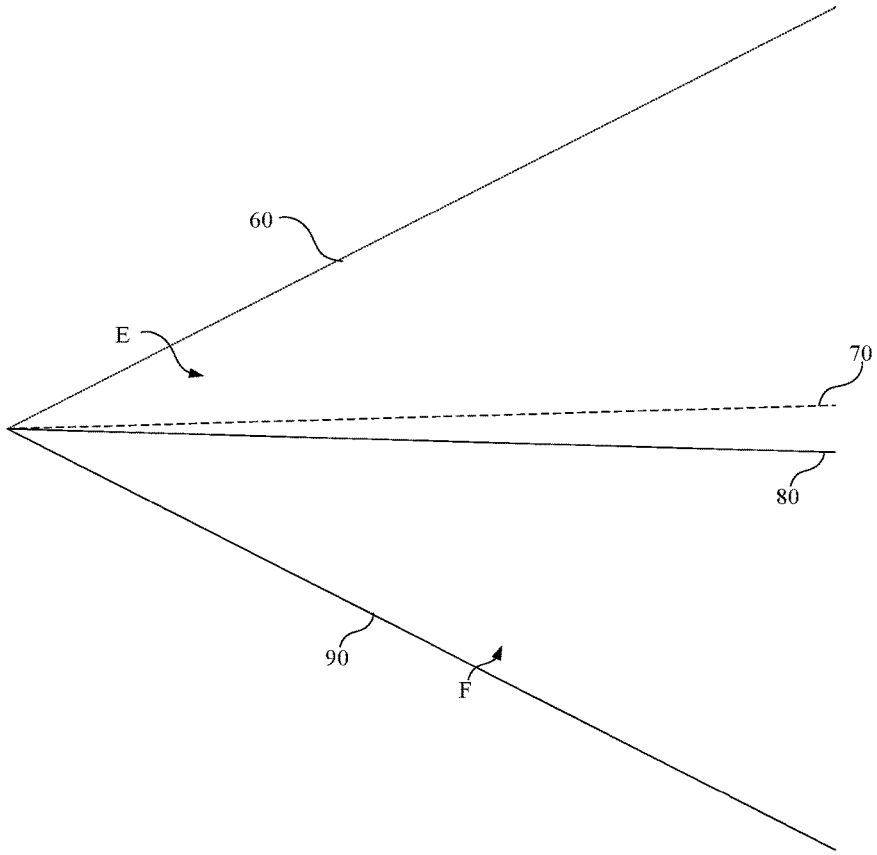
FIG. 7 is another application scene diagram of the elastic buffer belt of the present disclosure.
FIG. 8 is a schematic diagram of a part of an organizational structure of the single strand section of the present disclosure.

Referring to FIG. 6 and FIG. 7, the energy absorber of the present disclosure is described as below:

The energy absorber as shown in FIG. 1 can be woven by weaving warp yarns and weft yarns through two weft needles and two sheds.

Specifically, a main shaft of the weaving device is rotated to drive a steel buckle connecting rod group to eccentrically move, so that a steel buckle seat swings back and forth. When swinging back and forth, the steel buckle seat drives a weft aluminum hand to make an arc swing, a weft needle is fixed on the weft aluminum hand. The weft aluminum hand swings, so that the weft needle brings the weft yarn to pass through the shed and hook into the weaving needle, and the two weft needles pass through the upper and lower sheds respectively. As shown in FIG. 6, the weft needle 20 brings the weft yarn 40 to pass through the shed E and hook into the weaving needle, and the weft needle 20 passes through the shed E for weaving. And the weft needle 30 brings the weft yarn 50 to pass through the shed F and hook into the weaving needle, and the weft needle 30 passes through the shed F for weaving.

The sheds are openings created by the up and down movements of the warp yarn. The present disclosure has two sheds which are formed by the drive of the brown frame.

In some embodiments, when weaving the first single strand section or the second single strand section, all warp yarns and elastic belts are driven by the brown frame to form two sheds. The upper layer belt and the bottom layer belt are respectively interwoven with warp yarn and weft yarn to form two ribbons. The suture rises and falls, and interweaves with two layers of weft yarn to suture the two ribbons together. Different areas have different suturing densities, so that different areas of the ribbon have different tearing buffer force. As shown in FIG. 4, when suturing, the elastic belt does not interweave with the warp yarn and the weft yarn, and always be above the upper layer belt. Specifically, referring to FIG. 7, the brown frame (not shown) is configured to separate the first face yarn layer 60 from the first bottom yarn layer 70 to form a shed E, and separate the second face yarn layer 80 from the second bottom yarn layer 90 to form a shed F. The structure of the first single strand section or the second single strand section is shown in FIG. 5.

In some embodiments, when weaving the first split section or the third split section, the suture is interwoven with the upper layer weft yarn and bottom layer weft yarn independently, and the elastic belt is interwoven back and forth with the face yarn layer and the bottom yarn layer of the upper layer belt. When the elastic belt is interwoven with the face yarn layer, and not interwoven with the bottom yarn layer, the face yarn layer of the ribbon is capable of being stretched and contracted as interweaving with the elastic belt, and the bottom yarn layer is not capable of being stretched and contracted, so the face yarn layer of the ribbon is curved downward. When the elastic belt is interwoven with the bottom yarn layer and not interwoven with the face yarn layer, the bottom yarn layer of the ribbon is capable of being stretched and contracted as interweaving with the elastic belt, the face yarn layer is not capable of being stretched and contracted, so that the bottom yarn layer is curved upward. The bottom ribbon does not have the elastic belt, so the bottom layer belt is a flat ribbon. Specifically, referring to FIG. 7, the brown frame (not shown) is configured to separate the first face yarn layer 60 from the first bottom yarn layer 70 to form a shed E, and configured to separate the second face yarn layer 80 from the second bottom yarn layer 90 to form shed F. The structure of the first split section or the second split section is shown in FIG. 2.

In some embodiments, when the second split section is woven, the suture rises and falls to independently interweave with the upper layer weft yarn and bottom layer weft yarn, instead of interweaving with the upper layer weft yarn and bottom layer weft yarn simultaneously, so the second split section has a split. When the second split section is woven, the elastic belt is interweaved with the upper layer belt and the weaving density of the elastic belt and the upper layer weft yarn and the bottom layer weft yarn is high within a unit distance, so that the elastic belt can be tightly interwoven with the weft yarns, and the second split section is not prone to loosen. Specifically, referring to FIG. 7, the brown frame (not shown) is configured to separate the first face yarn layer 60 from the first bottom yarn layer 70 to form shed E, and separate the second face yarn layer 80 from the second bottom yarn layer 90 to form shed F. The structure of the second split section is shown in FIG. 5.

In some embodiments, the first single strand section or the second single strand section is woven according to the organizational structure as shown in FIG. 8. The first split section or the third split section is woven according to the organizational structure as shown in FIG. 9. The second split section is woven according to the organizational structure as shown in FIG. 10.

Different from the existing art, the energy absorber of the present disclosure includes a first split section, a first single strand section, a second split section, a second single strand section, and a third split section which are connected in sequence. The first split section and the third split section each include at least two sub-woven belts, the at least two sub-woven belts are separated from each other, at least one of the at least two sub-woven belts is capable of being stretched and contracted under an action of an external force, the first split section, the first single strand section, the second split section, the second single strand section, and the third split section are integrally woven. Through the above method, the first split section and the third split section which are capable of being stretched and contracted are woven with the first single strand section, the second split section, and the second single strand section which have a buffer function together, so as to eliminate a subsequent sewing operation, save ribbon materials, reduce labor costs, and improve the beauty of the energy absorber through an integrated weaving mode. The energy absorber of the present disclosure can be used for personal fall protector and high-altitude rescue protector.

Further, the warp yarns and the weft yarns are interwoven by using two weft needles and two sheds to form two ribbons, and the suture is configured to connect the two ribbons. Different areas have different suturing densities, so that different areas of the ribbons have different buffering forces. The elastic belt and the single layer belt are used as organization connector, for integrally weaving the energy absorber.

FIG. 11 is a flow chart of a method for weaving an energy absorber according to an embodiment of the present disclosure, the method includes the following steps:

step 201: weaving a first split section, a first single strand section, a second split section, a second single strand section, and a third split section in sequence.

The first split section and the third split section each include at least two sub-woven belts, the at least two sub-woven belts are separated from each other, at least one of the at least two sub-woven belts is capable of being stretched and contracted under an action of an external force, the first split section, the first single strand section, the second split section, the second single strand section, and the third split section are integrally woven.

In some embodiments, the first split section 11 includes a first sub-woven belt 111 and a second sub-woven belt 112. A first end of the first sub-woven belt 111 and a first end of the second sub-woven belt 112 are connected to the first single strand section 12, and the first sub-woven belt is capable of being stretched and contracted under the action of the external force.

In some embodiments, the first sub-woven belt 111 includes a first face yarn layer 1111, a first bottom yarn layer 1112, a first elastic belt 1113, and a first suture 1114. The first face yarn layer 1111 is opposite to the first bottom yarn layer 1112, and the first elastic belt 1113 is interwoven with the first face yarn layer 1111 and the first bottom yarn layer 1112 at intervals according to a first preset interweaving density, the first suture 1114 is interwoven with the first face yarn layer 1111 and the first bottom yarn layer 1112.

In some embodiments, the first elastic belt 1113 is interwoven with the first face yarn layer 1111 to form a first area A, a second area B in the first bottom yarn layer 1112 corresponding to the first area A is curved due to a contraction of the first elastic belt 1113, the first elastic belt 1113 is interwoven with the first bottom yarn layer 1112 to form a third area C, and a fourth area D in the first face yarn layer 1111 corresponding to the third area C is curved due to the contraction of the first elastic belt 1113.

In some embodiments, the first single strand section 12 includes a third sub-woven belt 121, a fourth sub-woven belt 122, and a second elastic belt 123, the third sub-woven belt 121 is connected to the first sub-woven belt 111, and the fourth sub-woven belt 122 is connected to the second sub-woven belt 112, the second elastic belt 112 is connected to the first elastic belt 111, the third sub-woven belt 121 is interwoven with the fourth sub-woven belt 122 by the second suture 124, the second elastic belt 123 is arranged on a side of the third sub-woven belt 121 away from the fourth sub-woven belt 122.

In some embodiments, an interweaving density of the second suture 124 is decreased along a split direction of the first split section 11.

In some embodiments, the second split section 13 includes a fifth sub-woven belt 131, a sixth sub-woven belt 132, and a third elastic belt 133, the fifth sub-woven belt 131 is connected to the third sub-woven belt, the sixth sub-woven belt 132 is connected to the fourth sub-woven belt, the third elastic belt 133 is connected to the second elastic belt 123, the fifth sub-woven belt 131 is separated from the sixth sub-woven belt 132, and the third elastic belt 133 is interwoven with the fifth sub-woven belt 131.

In some embodiments, the fifth sub-woven belt 131 is curved relative to the sixth sub-woven belt 132.

In some embodiments, the energy absorber as shown in FIG. 1 can be woven according to the organizational structure as shown in FIG. 8 to FIG. 10.

Different from the existing art, the method for weaving the energy absorber of the present disclosure can be used to weave the energy absorber as recited in the above-mentioned embodiments. Through the above method, the first split section 11 and the third split section 15 which are capable of being stretched and contracted are interwoven with the first single strand section 12 and the second split section 13 and the second single strand section 14 which have the buffer function, for eliminating a subsequent sewing operation, saving ribbon materials, reducing labor costs, and improving the beauty of the energy absorber through an integrated weaving mode. The energy absorber of the present disclosure can be used for personal fall protector and high-altitude rescue protector.

In some embodiments, the present disclosure further provides a weaving device. The weaving device is configured to perform the method as mentioned above to weave the energy absorber as shown in FIG. 1 according to the organization structure as shown in FIG. 8 to FIG. 10.

The foregoing are only embodiments in accordance with the present disclosure and therefore not intended to limit the patentable scope of the present disclosure. Any equivalent structure or flow transformations that are made taking advantage of the specification and accompanying drawings of the disclosure and any direct or indirect disclosures thereof in other related technical fields are within the protection scope of the present disclosure.

What is claimed is:

1. An energy absorber, comprising:

a first split section;

a first single strand section;

a second split section;

a second single strand section; and a third split section;

wherein, the first split section, the first single strand section, the second split section, the second single strand section and the third split section are connected in sequence;

the first split section and the third split section each include at least two sub-woven belts, the at least two sub-woven belts are separated from each other, at least one of the at least two sub-woven belts is capable of being stretched and contracted under an action of an external force, the first split section, the first single strand section, the second split section, the second single strand section, and the third split section are integrally woven;

the first split section comprises a first sub-woven belt and a second sub-woven belt, wherein a first end of the first sub-woven belt and a first end of the second sub-woven belt are connected to the first single strand section, and the first sub-woven belt is capable of being stretched and contracted under the action of the external force; and the first single strand section comprises a third sub-woven belt, a fourth sub-woven belt, a second elastic belt, and a second suture, the third sub-woven belt is connected to the first sub-woven belt, and the fourth sub-woven belt is connected to the second sub-woven belt, the second elastic belt is connected to the first elastic belt, the third sub-woven belt is interwoven with the fourth sub-woven belt by the second suture, and the second elastic belt is arranged on a side of the third sub-woven belt away from the fourth sub-woven belt.

2. The energy absorber according to claim 1, wherein, an interweaving density of the second suture is decreased along a split direction of the first split section.

3. The energy absorber according to claim 1, wherein, the second split section comprises a fifth sub-woven belt, a sixth sub-woven belt, and a third elastic belt, the fifth sub-woven belt is connected to the third sub-woven belt, the sixth sub-woven belt is connected to the fourth sub-woven belt, the third elastic belt is connected to the second elastic belt, the fifth sub-woven belt is separated from the sixth sub-woven belt, and the third elastic belt is interwoven with the fifth sub-woven belt.

4. The energy absorber according to claim 3, wherein, the fifth sub-woven belt is curved relative to the sixth sub-woven belt.

5. A weaving device for performing a method for weaving an energy absorber, the method comprising:

weaving a first split section, a first single strand section, a second split section, a second single strand section, and a third split section in sequence, wherein, the first split section and the third split section each include at least two sub-woven belts, the at least two sub-woven belts are separated from each other, at least one of the at least two sub-woven belts is capable of being stretched and contracted under an action of an external force, the first split section, the first single strand section, the second split section, the second single strand section, and the third split section are integrally woven;

wherein, the energy absorber comprises:

a first split section;

a first single strand section;

a second split section;

a second single strand section; and a third split section;

wherein the first split section, the first single strand section, the second split section, the second single strand section and the third split section are connected in sequence;

the first split section and the third split section each include at least two sub-woven belts, the at least two sub-woven belts are separated from each other, at least one of the at least two sub-woven belts is capable of being stretched and contracted under an action of an external force, the first split section, the first single strand section, the second split section, the second single strand section, and the third split section are integrally woven;

the first split section comprises a first sub-woven belt and a second sub-woven belt, wherein a first end of the first sub-woven belt and a first end of the second sub-woven belt are connected to the first single strand section, and the first sub-woven belt is capable of being stretched and contracted under the action of the external force; and the first single strand section comprises a third sub-woven belt, a fourth sub-woven belt, a second elastic belt, and a second suture, the third sub-woven belt is connected to the first sub-woven belt, and the fourth sub-woven belt is connected to the second sub-woven belt, the second elastic belt is connected to the first elastic belt, the third sub-woven belt is interwoven with the fourth sub-woven belt by the second suture, and the second elastic belt is arranged on a side of the third sub-woven belt away from the fourth sub-woven belt.

6. The weaving device according to claim 5, wherein, an interweaving density of the second suture is decreased along a split direction of the first split section.

7. The weaving device according to claim 5, wherein, the second split section comprises a fifth sub-woven belt, a sixth sub-woven belt, and a third elastic belt, the fifth sub-woven belt is connected to the third sub-woven belt, the sixth sub-woven belt is connected to the fourth sub-woven belt, the third elastic belt is connected to the second elastic belt, the fifth sub-woven belt is separated from the sixth sub-woven belt, and the third elastic belt is interwoven with the fifth sub-woven belt.

8. The weaving device according to claim 7, wherein, the fifth sub-woven belt is curved relative to the sixth sub-woven belt.

9. The energy absorber according to claim 1, wherein the first sub-woven belt comprises:

a first face yarn layer;

a first bottom yarn layer;

a first elastic belt; and a first suture;

wherein the first face yarn layer is opposite to the first bottom yarn layer; the first elastic belt is interwoven with the first face yarn layer and the first bottom yarn layer at intervals according to a first preset interweaving density; and the first suture is interwoven with the first face yarn layer and the first bottom yarn layer.

10. The energy absorber according to claim 9, wherein the first elastic belt is configured to be interwoven with the first face yarn layer to form a first area; a second area in the first bottom yarn layer corresponding to the first area is curved due to a contraction of the first elastic belt; and the first elastic belt is configured to be interwoven with the first bottom yarn layer to form a third area; and a fourth area in the first face yarn layer corresponding to the third area is curved due to the contraction of the first elastic belt.

* * * * *